US006208257B1

(12) United States Patent
Choi

(10) Patent No.: US 6,208,257 B1
(45) Date of Patent: Mar. 27, 2001

(54) INSPECTION APPARATUS OF AN EMERGENCY EXIT LIGHT

(75) Inventor: Man-Hyung Choi, Kyoungkee-do (KR)

(73) Assignee: Dong Bang Electronic Industrial Co., Ltd., Seoul (KR)

( * ) Notice: Subject to any disclaimer, the term of this patent is extended or adjusted under 35 U.S.C. 154(b) by 0 days.

(21) Appl. No.: 09/313,053

(22) Filed: May 17, 1999

(30) Foreign Application Priority Data

Jun. 13, 1998 (KR) ..... 98-10110

(51) Int. Cl.[7] ..... G08B 21/00

(52) U.S. Cl. ..... 340/635; 340/628; 340/644; 340/514; 340/331; 340/332; 340/691

(58) Field of Search ..... 340/635, 628, 340/644, 514, 332, 331, 691, 371

(56) References Cited

U.S. PATENT DOCUMENTS 4,271,693 * 6/1981 Bute ..... 73/1 G
4,283,657 * 8/1981 Gordon ..... 315/86
4,489,308 * 12/1984 Logan, Jr. et al. ..... 340/286 R
4,901,056 * 2/1990 Bellavia et al. ..... 340/514
5,148,158 * 9/1992 Shah ..... 340/825.17
5,416,384 * 5/1995 Bavaro ..... 315/86

* cited by examiner

*Primary Examiner*—Jeffery Hofsass
*Assistant Examiner*—Hung Nguyen
(74) *Attorney, Agent, or Firm*—Finnegan, Henderson, Farabow, Garrett & Dunner, L.L.P.

(57) ABSTRACT

The present invention relates to an inspection apparatus of an emergency exit light which is mounted on a wall or a ceiling in order to guide people to the emergency exit in a building in an emergency situation, such as a fire. Particularly, the present invention relates to the inspection apparatus of an emergency exit light for checking whether or not the reserve power supply charged in the secondary battery can be supplied to the emergency exit light to automatically turn on the exit light as soon as the domestic power supply which has been supplied to the emergency exit light is cut off due to the occurrence of an emergency situation, such as a fire.

1 Claim, 4 Drawing Sheets

INSPECTION APPARATUS OF AN EMERGENCY EXIT LIGHT

BACKGROUND OF THE INVENTION

1. Field of the Invention

The present invention relates to an inspection apparatus of an emergency exit light wherein the emergency exit light can be easily inspected by using a reed switch or a photosensitive switch, instead of a pull switch or the push switch. Particularly, the present invention relates to the inspection apparatus of an emergency exit light to check whether or not the reserve power supply charged in the secondary battery can be supplied to the emergency exit light to turn on the exit light as soon as the domestic power supply, which has been supplied to the emergency exit light, is cut off due to the occurrence of an emergency situation, such as a fire. The emergency exit light is mounted on a wall or a ceiling in order to guide people to an exit.

Generally, an emergency exit light has the function to help people to escape to a safe place in the case of a fire, an earthquake or any other emergency situation. Usually, the emergency exit light is turned on using the domestic power supply and the current from the power supply flowing through the charging circuit is automatically provided to the secondary battery to charge the reserve power supply in the secondary battery. On the contrary, in an emergency situation, the domestic power supply is often cut off, thus the reserve power supply which has been charged in the secondary battery may be supplied to the emergency exit light to turn on the light. Accordingly, the emergency exit light continuously functions to notify the exact position of the emergency exit to people.

2. Description of the Prior Art

Accordingly, in the conventional inspection apparatus of an emergency exit light, in order to inspect whether the emergency exit light can be operated normally by the reserve power supply in an emergency situation, such as a fire, the inspector should activate a pull switch or a push switch. Owing to the activation of the pull switch or the push switch, the contact terminal is contacted and simultaneously the domestic power supply is cut off.

When the domestic power supply is cut off, the reserve power supply may be supplied to the emergency exit light (1). In this way, according to the inspection apparatus, it is possible to check whether the reserve power supply charged in the secondary battery can be immediately supplied to the emergency exit light to turn on the light normally when the domestic power supply is cut off.

However, in the conventional inspection apparatus as described before, if the emergency exit light is installed in a high position such as on the upper part of a wall or on a ceiling, it was difficult to directly activate the pull switch or the push switch without any implement, for example a ladder. Consequently, it was possible to inspect the emergency exit light only if using an implement such as a ladder. Accordingly, it was inconvenient for the inspector to inspect whether the emergency exit light was working properly.

For this reason, the inspector very often left the inspection of the emergency exit light undone. Consequently, in an emergency situation such as a fire, the reserve power supply charged in the secondary battery could not be supplied to the emergency exit light owing to the malfunction of the switch or the malfunction of the secondary battery, so the emergency exit light was not lit up in an emergency. Accordingly, the exit light can not guide people to a secure place swiftly. In this case, there still remained a problem of damage or injury of lives.

SUMMARY OF THE INVENTION

In view of the foregoing, the objective of the present invention is to provide an inspection apparatus of the emergency exit light wherein it is possible to check whether the reserve power supply charged in the secondary battery can be supplied to the emergency exit light to turn on the light normally, as soon as the domestic current supplied to the emergency exit is cut off in an emergency situation, by the use of a reed switch and the magnetic force of the magnet mounted on the end of the telescopic rod, instead of a pull switch or a push switch.

Another objective of the present invention is to provide an inspection apparatus of an emergency exit light wherein it is possible to check whether the reserve power supply charged in the secondary battery can be supplied to the emergency exit light to turn on the light normally, as soon as the laser beam emitted from the light emitting portion of a laser pointer is sensed by the light receiving portion of a photosensitive switch and simultaneously the photosensitive switch (for example, a phototransistor or a CDS cell) is turned on and the domestic current (10) is cut off.

Therefore, using the present inspection apparatus, the inspector is capable of inspecting if the reserve power supply can be supplied to the emergency exit light to turn on the light in an emergency, regardless of the installation position and height of the emergency exit light.

DETAILED DESCRIPTION OF THE EMBODIMENT

Figure 1:
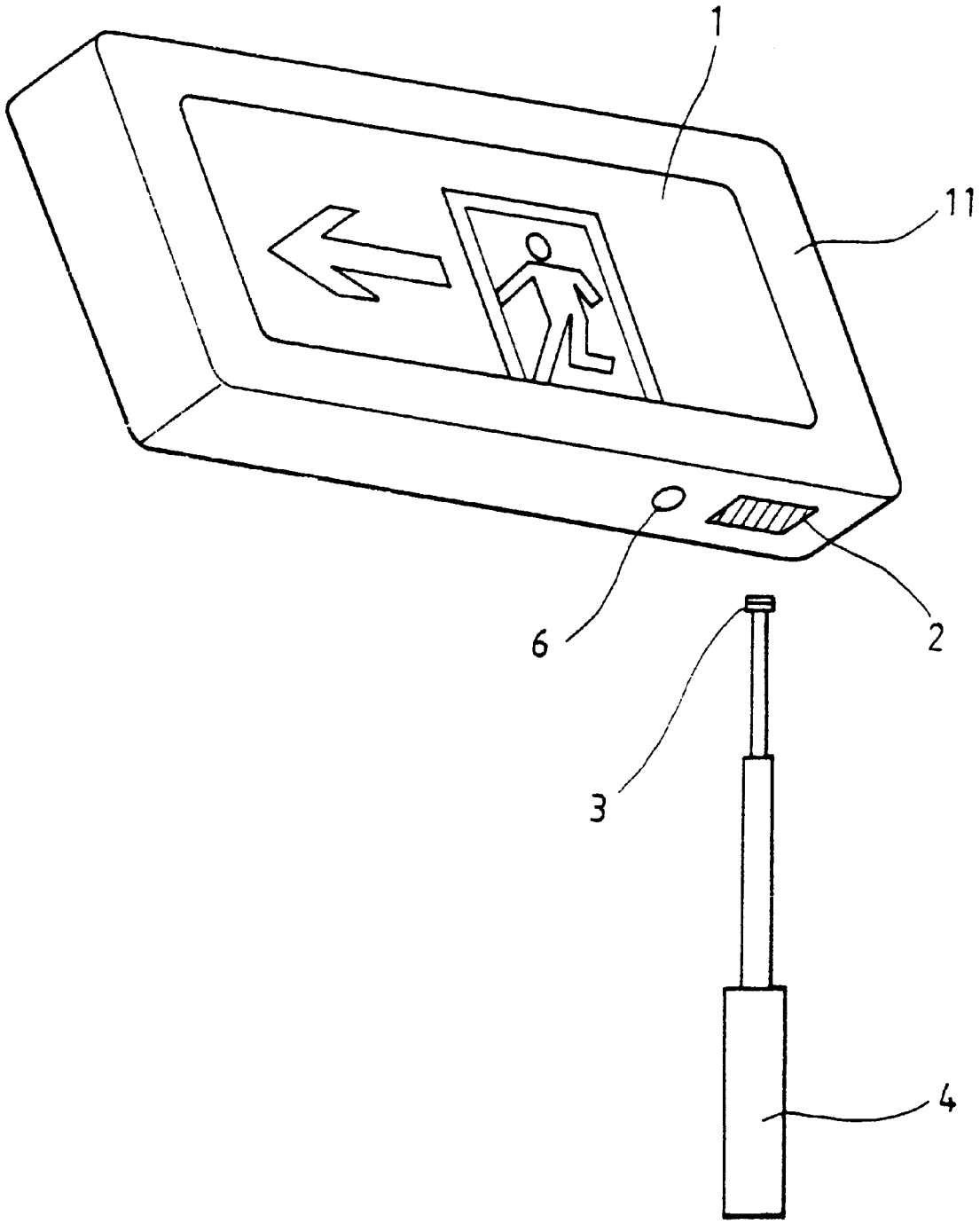
FIG. 1 is the perspective view showing the state in which the inspection apparatus according to the present invention is used.
Figure 2:
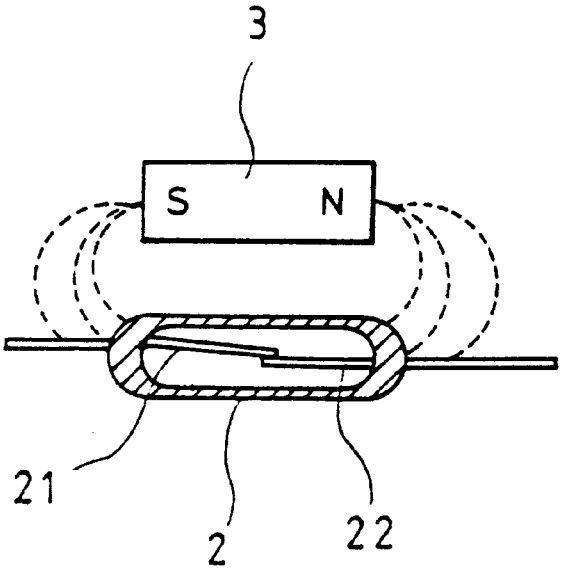
FIG. 2 is the view for illustrating the state that the magnetic substances of the reed switch are contacted to each other.
Figure 3:
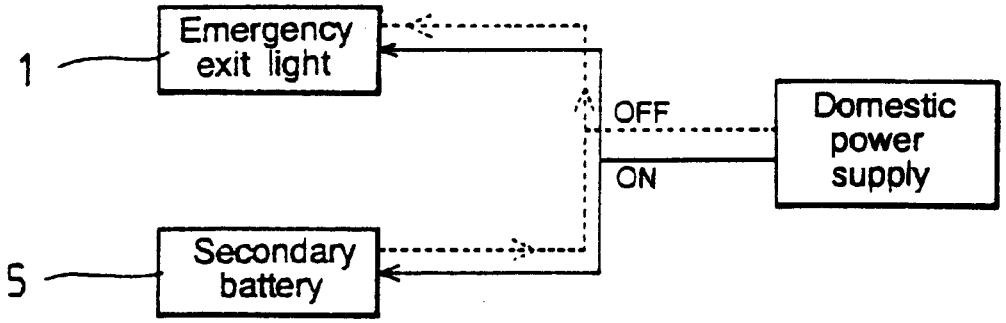
FIG. 3 is the block view for illustrating the structure for checking whether the emergency exit light can be operated normally or not.

The structure of this invention to accomplish the above objectives will be more apparent from the following description explained with reference to the accompanying drawings.

The inspection apparatus of an emergency exit light (1) turned on with the domestic power supply which comprises a secondary battery (5) charged with the reserve power supply in order to light up the emergency exit light (1) in the event of cutting off of the said domestic power supply and a pull switch or a push switch operated outside of the emergency exit case (11) to cut off the domestic power supply; wherein the inspection apparatus of the emergency exit light (1) has the construction that as soon as the magnetic substances (21, 22) of the reed switch (2) mounted on the outside surface of the emergency exit case (11) are contacted to each other by the magnetic force of the magnet (3) installed on the end of the telescopic rod (4) and the domestic current is cut off, it is possible to check whether the reserve power supply charged in the secondary battery (5) is able to be supplied normally to the emergency exit light (1) in an emergency situation.

Further, on the outside surface of the emergency exit case (11), a photosensitive switch (7) including a light receiving portion (70) is mounted. The inspection apparatus of the emergency exit light (1) has the construction that the photosensitive switch (for example, a phototransistor or a CDS cell) is turned on and simultaneously the domestic current (10) is cut off, as soon as a laser beam emitted from the light emitting portion (80) of the laser pointer (8) by operating of the switch (81), is sensed by the light receiving portion (70), thus it is possible to check whether the reserve power supply charged in the secondary battery (50) is able to be supplied normally to the emergency exit light (1) in an emergency situation.

The operation effect of the inspection apparatus according to the present invention constructed as described previous is explained in detail hereinafter.

According to the first embodiment of the present invention, as illustrated in FIG. 1, the reed switch(2) is mounted on the outside surface of the emergency exit case (11) of an emergency exit light (1) which is installed on a wall or a ceiling of a building.

The telescopic rod (4) is constructed to be capable of being inserted or withdrawn by sliding in stages. On the end of the telescopic rod (4) is installed a magnet (3). Therefore, in order to check at any time whether the emergency exit light (1) can be turned on normally or not by the reserve power supply charged in the secondary battery (5) even in an emergency, such as a fire, the inspector places the magnet (3) of the telescopic rod (4) near to the reed switch (2), then at this time, the magnetic force from the magnet (3) reaches the reed switch (2). Thereafter, the magnetic force which has been reached the reed switch (2) makes the two magnetic substances (21, 22) in the reed switch (2) touch each other. When these magnetic substances (21, 22) touch each other, the domestic current which has been flowing toward the emergency exit light (1) is cut off instantly.

The inspection apparatus is constructed such that a reserve power supply charged in the secondary battery (5) in the emergency exit case (11) may be activated due to the failure of the domestic current in an emergency, as soon as the domestic power supply is cut off. In other words, once the domestic current is cut off, the direct current which corresponds to the reserve power supply charged in the secondary battery (5) is supplied to the emergency exit light (1) without delay, thus it is possible to confirm whether the emergency exit light (1) can be turned on by the reserve power supply charged in the secondary battery (5).

As described above, the operation for checking whether or not the reserve power supply charged in the secondary battery (5) can be supplied to the emergency exit light (1) without delay in an emergency is as follows. When the magnet (3) installed on the end of the telescopic rod (4) is adjacent to the reed switch (2) mounted on the outside surface of an emergency exit case (11), two magnetic substances (21, 22) of the reed switch (2) are contacted to each other by the magnetic force from the magnet (3), and simultaneously the domestic current which has been flowing toward the emergency exit light (1) is cut off. Thereafter, once the domestic power supply is cut off, the reserve power supply charged in the secondary battery (5) is supplied to the emergency exit light (1) to turn on the exit light (1). In this way, it is possible to check easily whether or not the emergency exit light (1) can be operated by the reserve power supply charged in the secondary battery (5) though the domestic current supplied to the emergency exit light (1) is cut off in an emergency.

Moreover, the telescopic rod (4) on the end of which the magnet (3) is mounted is constructed to be inserted or withdrawn by sliding in stages as needed.

Figure 4:
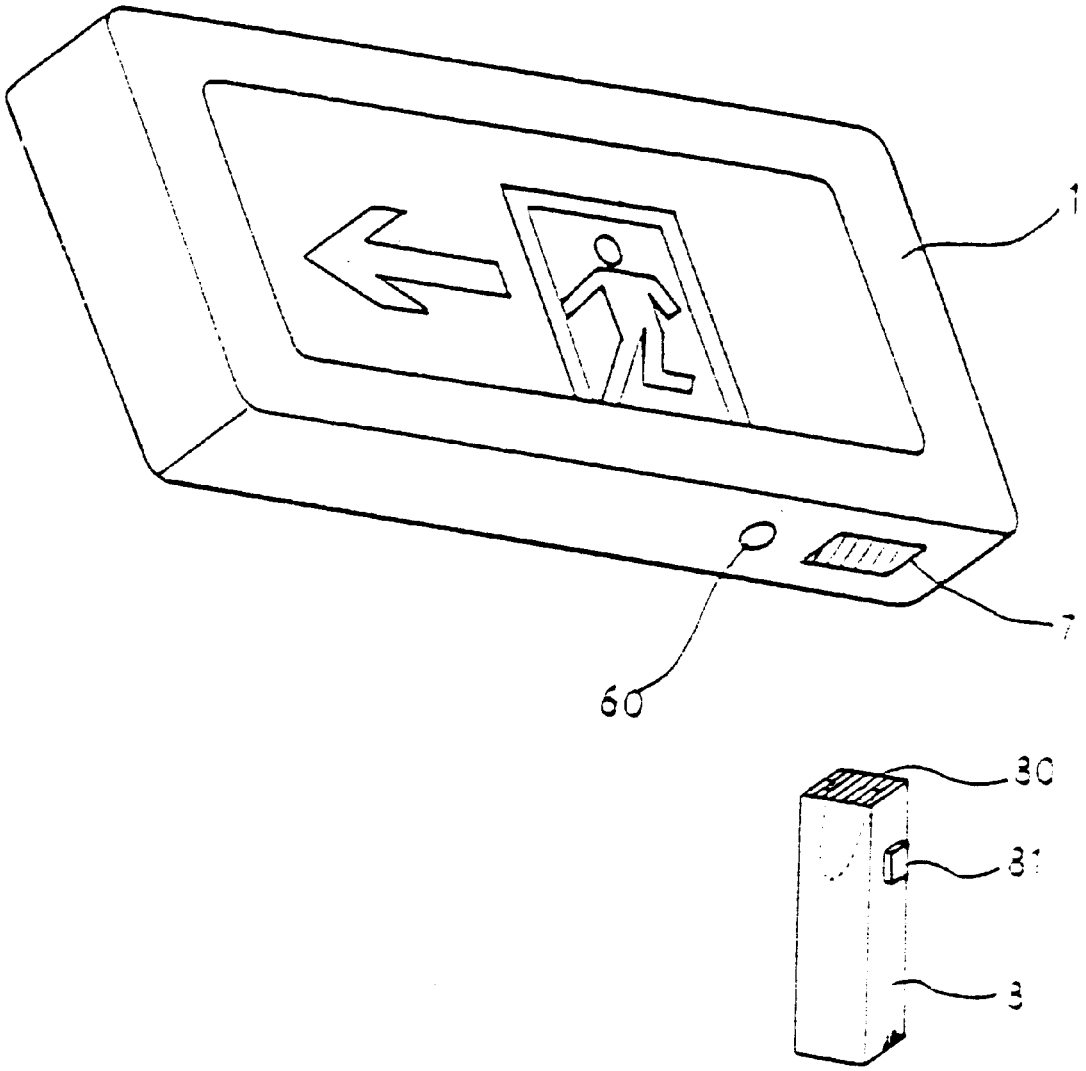
FIG. 4 is the perspective view showing another embodiment according to the present invention.
Figure 5:
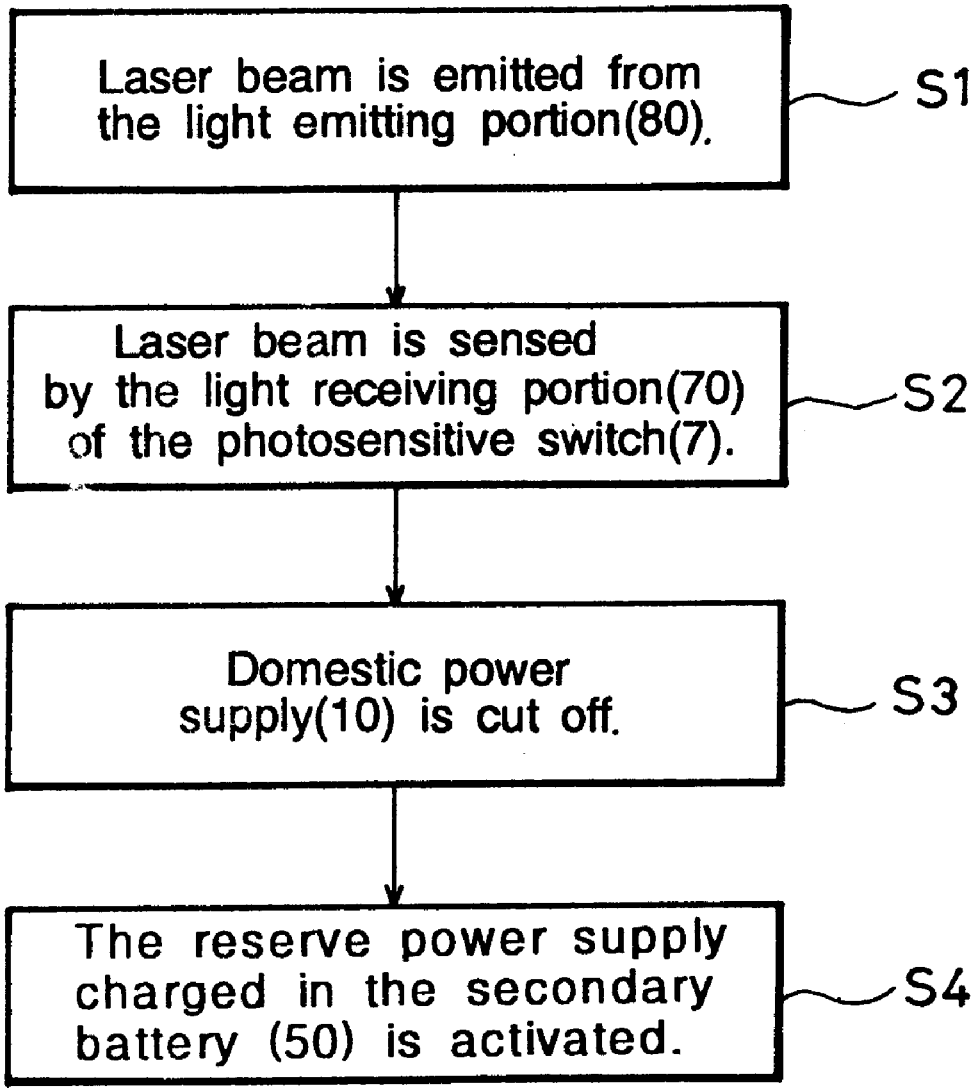
FIG. 5 is the flowchart for explaining the operation state of the second embodiment according to the present invention.

Furthermore, as illustrated in the FIG. 4 and the FIG. 5, the inspection apparatus according to the second embodiment of the present invention is as follows.

The inspection apparatus according to the second embodiment comprises a photosensitive switch (7) including a light receiving portion (70) which is mounted on the outside of the emergency exit case (11) and a laser pointer (8) of which a light emitting portion (80) can emit the laser light, similarly to the first embodiment. Thereafter, in order to check whether or not the emergency exit light (1) can be normally operated by the reserve power supply charged in the secondary battery (50), the inspector first makes the laser pointer (8) point to the photosensitive switch (7), including the light receiving portion (70), and then presses the switch (81), so that the laser beam is emitted from the light emitting portion (80) of the laser pointer (8) toward the photosensitive switch (7) by the switching operation of the switch (81) (step S1). Then, when the laser beam emitted from the light emitting portion (80) is sensed by the light receiving portion (70) (step S2), the photosensitive switch (7) (for example, a phototransistor or a CDS cell) is turned on. At this time, the domestic current which has been supplied to the emergency exit light (1) is cut off without delay (step S3).

As soon as the domestic current (10) supplied to the emergency exit light (1) is cut off, the reverse power supply which is the direct current charged in advance in the secondary battery (50) is promptly activated to turn on the emergency exit light (1) (step S4). In this way, using the inspection apparatus, it is possible to check easily whether the reserve power supply charged in the secondary battery (50) can normally be supplied to the emergency exit light (1) in an emergency situation.

Meantime, the light emitting diode (LED) (6) is constructed to inform the inspector as to whether the reserve power supply has been charged in the secondary battery (5, 50).

As described before, with the inspection apparatus, any implements, such as the ladder are not required for inspection of the emergency exit light. The inspection apparatus is constructed such that it is possible to check easily whether or not the reserve power supply charged in the secondary battery can be normally supplied to an emergency exit light to turn on the light by the use of a magnetic force or a laser beam, regardless of the position of the emergency exit light. Accordingly, the inspector seldom leaves the inspection of the emergency exit light undone. Further, it is possible to safely guide people to a safe place in an emergency.

What is claimed is:

1. The inspection apparatus of an emergency exit light (1), turned on with the domestic power supply, which comprises the secondary battery (5) charged with the reserve power supply in order to light up the emergency exit light (1) in the event of cutting off of said domestic power supply and a pull switch or a push switch operated outside of the emergency exit case (11) to cut off the domestic power supply; wherein the inspection apparatus of an emergency exit light (1) has the construction that as soon as a reed switch (2) mounted on the outside surface of the emergency exit case (11) is adjacent by the magnet (3) installed on the end of the telescopic rod (4), the magnetic substances (21, 22) of the reed switch (2) are contacted to each other by the magnetic force of the magnet (3) and the domestic current will be cut off, thus it is possible to check whether the reserve power supply is able to be supplied normally to the emergency exit light in an emergency situation.

* * * * *